US005769251A

United States Patent [19]

Wada et al.

[11] Patent Number: 5,769,251

[45] Date of Patent: Jun. 23, 1998

6

[54] CONTROLLING OPERATIONS OF A REACH TOWER CRANE

[75] Inventors: Minoru Wada; Takeshi Ushioda; Shinichi Ohta, all of Sayama; Hiroyuki Sawabe, Hannou, all of Japan

[73] Assignees: Komatsu Ltd.; Komatsu Mec Kabushiki Kaisha, both of Tokyo, Japan

[21] Appl. No.: 637,804

[22] PCT Filed: Nov. 8, 1994

[86] PCT No.: PCT/JP94/01874

§ 371 Date: May 8, 1996

§ 102(e) Date: May 8, 1996

[87] PCT Pub. No.: WO95/13239

PCT Pub. Date: May 18, 1995

[30] Foreign Application Priority Data

Nov. 8, 1993 [JP] Japan ..... 5/302267

[51] Int. Cl.[6] ..... B66C 23/42

[52] U.S. Cl. ..... 212/289; 212/290; 212/292; 212/296; 212/300; 212/231; 212/347; 212/270

[58] Field of Search ..... 212/289, 290, 212/296, 300, 231, 347, 168, 270, 292

[56] References Cited

U.S. PATENT DOCUMENTS

| | | | |
|---|---|---|---|
| 3,831,771 | 8/1974 | Wiencek | 212/300 |
| 3,944,081 | 3/1976 | Wellman | 212/296 |
| 5,115,925 | 5/1992 | Koizumi | 212/347 |
| 5,193,698 | 3/1993 | Koizumi | 212/347 |

FOREIGN PATENT DOCUMENTS

| | | |
|---|---|---|
| 61-142784 | 9/1986 | Japan . |
| 63-41092 | 3/1988 | Japan . |
| 2-115380 | 9/1990 | Japan . |
| 3-4475 | 1/1991 | Japan . |
| 3-56789 | 5/1991 | Japan . |
| 4-11476 | 2/1992 | Japan . |
| 4-85298 | 3/1992 | Japan . |
| 4-091512 | 8/1992 | Japan . |
| 6-49481 | 7/1994 | Japan . |

*Primary Examiner*—Thomas J. Brahan
*Attorney, Agent, or Firm*—Sidley & Austin

[57] ABSTRACT

An apparatus and a method for controlling the operation of a reach tower crane, in which a horizontal boom can safely and securely be operated or stored by one operator in the cab, and in which even if sensors are out of order, the stability of the crane can be secured. The system has a plurality of sensors for detecting a condition of an actuator (6) actuating an apparatus to operate or store a horizontal boom (5), a controller (36) for sending a control signal based on signals from the sensors, and hydraulic apparatuses for controlling various actuators in accordance with the control signal. Further, an operation lever and an operation switch are used to extend or store the horizontal boom (5).

20 Claims, 12 Drawing Sheets

CONTROLLING OPERATIONS OF A REACH TOWER CRANE

TECHNICAL FIELD

This invention relates to a system and a method for controlling the operation of a reach tower crane, in particular, a system and a method for controlling the operation of a reach tower crane in which a horizontal boom can safely and easily be operated or stored by one operator in a cab.

BACKGROUND ART

A conventional reach tower crane is generally equipped with an arm as shown in, for example, Japanese Utility Model Application Laid-open (U) 63-41092. The arm comprises a vertical boom and a vertically swingable horizontal boom connected therewith. When the crane travels, the vertical boom is positioned horizontally, and the horizontal boom is positioned against the upper part of the vertical boom. On the other hand, during operation of the crane, the vertical boom is erected, and the horizontal boom is swingable upwardly and downwardly.

However, when the arm is folded, the vertical boom and the horizontal boom are overlaid on each other, thereby increasing the vertical dimension of the folded arm. As a result, while the crane is traveling, the folded arm presents an obstacle to the field of vision for an operator.

As a means to solve such problem, there has been proposed an apparatus to operate or store the horizontal boom of a reach tower crane as shown in, for example, Japanese Utility Model Application No. 4-091512 (published as Japanese Utility Model Application Laid-Open (U) 6-49481).

The reach tower crane is provided with a multiple stage telescopic vertical boom so that it can be extended upwardly or retracted downwardly in erecting or storing, and the vertical boom is provided with a multiple stage telescopic horizontal boom which is swingable upwardly and downwardly.

The apparatus provides for a field of vision for an operator during traveling of the crane, by pirouetting the horizontal boom from under the vertical boom in the widthwise direction of the vertical boom until it is parallel with a side of the vertical boom, and storing the booms with a reduced vertical dimension.

However, when pirouetting the horizontal boom, such prior art requires manual operation by another operator outside the cab, and is capable of working only in the condition that the vertical boom is retracted to its shortest length. Accordingly, in a limited space, working by using the prior art faces great difficulties, and is attended with danger.

Further, an operation of setting or removing a securing pin for both the vertical boom and the horizontal boom, and the operations of pirouetting, swinging upwardly and downwardly, and telescopically moving the horizontal boom, respectively, are independent operations. As a result, there are a lot of possibilities that a misoperation can cause danger, and that one apparatus can interfere with another one to cause breakage.

SUMMARY OF THE INVENTION

The present invention is made in order to eliminate the defects of the prior art. It is an object of the present invention to provide a system and a method for controlling the operation of a reach tower crane which enable a horizontal boom to safely and securely be operated or stored by one operator in a cab, and to also easily work in a limited space.

The first aspect of the present invention provides a system for controlling the operation of a reach tower crane, comprising:

- a plurality of sensors for detecting conditions of various actuators for operating an apparatus to operate or store the horizontal boom;
- a controller for transmitting a predetermined control signal on determining the control signal in accordance with a signal from a sensor;
- hydraulic apparatuses for controlling the operation of the various actuators in accordance with predetermined control signals transmitted from the controller;
- locking apparatuses for fixing the vertical boom and the horizontal boom; and
- operation levers and operation switches for enabling operational control in connection with operating or storing the horizontal boom, the operation levers and the operation switches being provided in the cab of the reach tower crane, wherein the locking apparatuses comprises:
  - a first locking apparatus securing the horizontal boom when stored in parallel with a side of the vertical boom; and
  - a second locking apparatus, provided on the head of the vertical boom, for securing, during crane operation, a joint bracket provided with the horizontal boom, the operation levers comprise:
    - one telescopic operation lever; and
    - one derricking operation lever,
    - the telescopic operation lever controlling the telescopic motion of the vertical boom, the telescopic motion of the horizontal boom, the operation of the rotary motor, and the operation of the second locking apparatus, and
    - the derricking operation lever controlling the derricking of the vertical boom and the horizontal boom, and
    - the operation switches comprise:
    - a selector switch for changeover between controlling the vertical boom and controlling the horizontal boom; and
    - an operation switch for operating the first locking apparatus.

The second aspect of the present invention provides a system for controlling the operation of a reach tower crane, comprising:

- a plurality of sensors for detecting conditions of various actuators for operating an apparatus to operate or store the horizontal boom;
- if a controller for transmitting a predetermined control signal on determining the control signal in accordance with a signal from a sensor;
- hydraulic apparatuses for controlling the operation of the various actuators, said apparatuses operating in accordance with predetermined control signals transmitted from the controller; and
- unloader valves provided in hydraulic circuits for telescopic motion of the vertical boom and the horizontal boom, wherein the unloader valves prevent the operation of extending the vertical boom and the horizontal boom in, accordance with a signal from the controller when a sensor or the like is out of order.

The configuration of the first or the second aspect enables an operator to start a subsequent operation after verifying the operation of each part of the crane by checking each sensor, so that the horizontal boom can be operated or stored by the one operator, and interference with misoperated apparatuses does not occur. Since the configuration also has the unloader valve to stop extension of the booms, when a sensor or the like is out of order, the boom can be retracted but cannot be extended, thereby securing safety.

The third aspect of the present invention is described below, using some of reference numerals appearing in FIG.5 and FIG.6 related to an embodiment of the present invention.

The third aspect provides a system for controlling the operation of a reach tower crane comprising:

a three position operating valve(61) for boom telescopic motion, having a hydraulic power source port, a tank port, and two actuator ports A and B;

a first solenoid selector valve (56) having a position B to connect one of the actuator ports A and B to both a second solenoid selector valve (57) and a first actuator (24), and to connect the other port to a third solenoid selector valve (58), by exciting the first solenoid selector valve, and a position A to respectively connect the ports A and B to a second actuator (7) by degaussing the first solenoid selector valve;

a second solenoid selector valve having a position B to connect the first solenoid selector valve to a third actuator (14) by exciting the second solenoid selector valve, and having a position A to connect the second solenoid selector valve to a check valve (73) to block a flow to the third actuator by degaussing the second solenoid selector valve;

a third solenoid selector valve having a position B to connect the first solenoid selector valve to the first actuator by exciting the third solenoid selector valve, and a position A to connect the first solenoid selector valve to the third actuator by degaussing the third solenoid selector valve;

a coupling pin (25), which is shown in FIG. 3, for locking the horizontal boom and the vertical boom; an operational position detection sensor (47) for detecting that the horizontal boom is operational;

a storing completion detection sensor (46) for detecting that the horizontal boom is stored;

an unlocking completion detection sensor (45) for detecting that the coupling pin is unlocked; and a controller (36) for receiving or sending a signal in connection with each of the selector valves or each of the detection sensors connected with the controller, wherein:

when the horizontal boom is operational, the horizontal boom and the vertical boom are locked by engaging the coupling pin under control of the controller such that when the third actuator reaches a predetermined position to come into contact with the operational position detection sensor by the third actuator driven by pressurized oil from the first selector valve via the position A of the third selector valve, a signal from the operational position detection sensor changes over the third selector valve to its position B to enable the pressurized oil from the first selector valve to drive the first actuator via the position B of the third selector valve; and/or when the horizontal boom is stored, the storing of the horizontal boom at a predetermined position is verified by the storing detection sensor under control of the controller such that when the coupling pin is unlocked by driving the first actuator by the pressurized oil after the second selector valve changes over to its position B, the unlocking is detected by the unlocking completion detection sensor to enable the third selector valve to change over to its position A, so that the pressurized oil drives the third actuator.

It is preferred that the first actuator has the locking position at one end and the unlocking position at the other end, and is a second locking cylinder for driving the coupling pin, the second actuator is a horizontal boom telescopic cylinder, and the third actuator is a rotary motor having the operational position at one end and the storing position at the other end.

The fourth aspect of the present invention provides; a method for controlling the operation of a reach tower crane, wherein the method comprises the steps of:

(a) starting to unlock by a first locking apparatus after a vertical boom is operated to be erected and a derricking angle detection sensor detects that the vertical boom is erected at a predetermined derricking angle;

(b) starting to pirouette a horizontal boom by driving a rotary motor after a detection sensor detects that the unlocking by the first locking apparatus is completed;

(c) starting to lock by a second locking apparatus after a turning angle detection sensor detects that the rotary motor has turned to a predetermined pirouetting angle;

(d) starting to erect the horizontal boom after a detection sensor detects that the locking is completed by the second locking apparatus; and (e) starting to telescopically move and derrick the horizontal boom after the derricking angle detection sensor detects that the horizontal boom is parallel with respect with the ground.

The fifth aspect of the present invention provides a method for controlling the operation of a reach tower crane, wherein the process of storing a horizontal boom comprises the steps of:

(a) starting to lower the horizontal boom after the vertical boom and the horizontal boom are retracted and a length detection sensor detects that both of the booms are retracted to their shortest length and a derricking angle detection sensor detects that the vertical boom is erected at a predetermined derricking angle;

(b) starting to unlock by a second locking apparatus after the derricking angle detection sensor detects that the horizontal boom is at a maximum angle of lowering;

(c) starting to pirouette the horizontal boom by driving a rotary motor after a detection sensor detects that the unlocking is completed by the second locking apparatus;

(d) starting to lock by a first locking apparatus after a turning angle detection sensor detects that the rotary motor has turned to a predetermined pirouetting angle; and (e) starting to lower the vertical boom after the detection sensor detects that locking is completed by the first locking apparatus.

As shown by the system and the method for controlling the operation of a reach tower crane as disclosed in the third to fifth aspects of the present invention, in this operation of moving the horizontal boom from its stored state, the third actuator is operated to the operational position, and the first actuator is subsequently operated to the locking position. When the first actuator is operated to the locking position, the second actuator is capable of being extended. Further in the operation of storing the horizontal boom from its operational state, the second actuator is firstly contracted. Subsequently, in order to unlock the locking by the coupling pin, an, operation-allowable signal is sent to the other end of the first actuator, by which the first actuator is operated. When the first actuator reaches the unlocking position, the third actuator is driven to the storing position.

As described above, one operating valve is capable of successively operating the three actuators.

BEST MODE FOR CARRYING OUT THE INVENTION

With respect to a system and a method for controlling the operation of a reach tower crane in accordance with the present invention, a preferred embodiment is described below, referring to the attached drawings.

Figure 1:
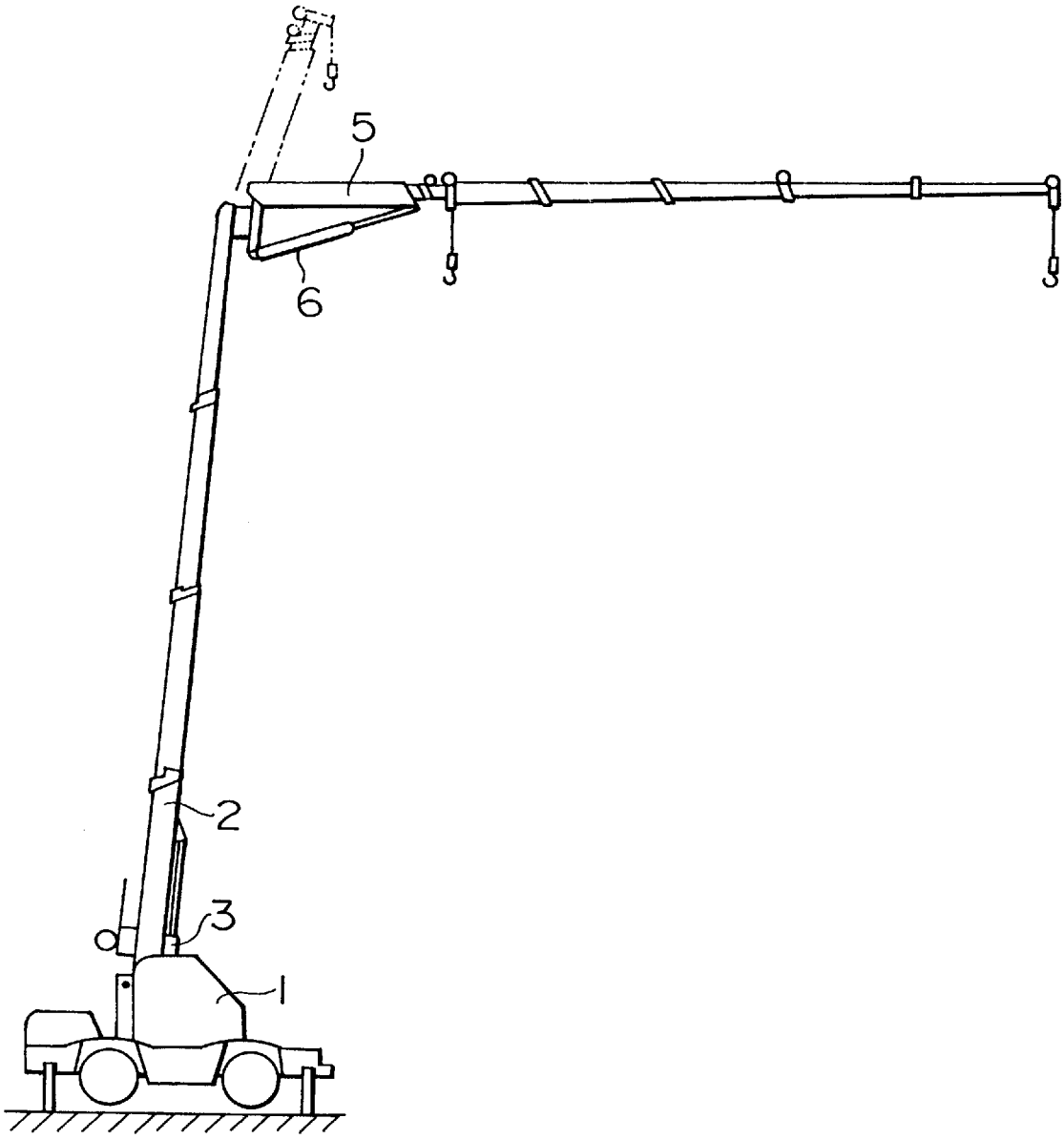
FIG. 1 is a schematic side view illustrating an operational state of a wheel-drive reach tower crane as an embodiment in accordance with the present invention.
Figure 5:
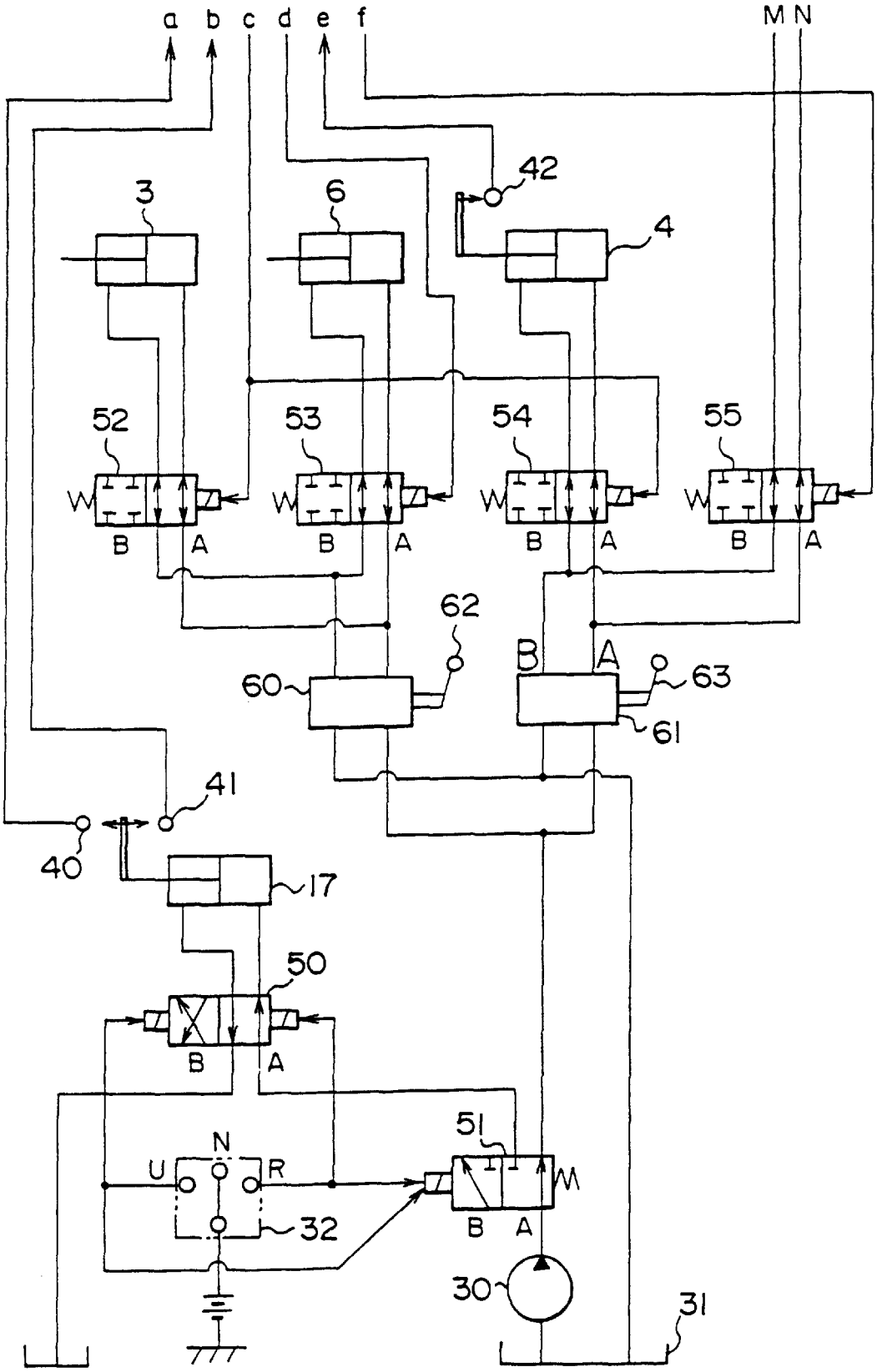
FIG. 5 is part of a hydraulic circuit illustrating a control system for operating or storing the horizontal boom of the embodiment.

Referring to FIG. 1, a vertical boom 2, which is provided on a body 1 so as to enable derricking, is operated by a vertical boom derricking cylinder 3. A vertical boom telescopic cylinder 4, which is included in the vertical boom 2 as shown in FIG. 5, telescopically moves the vertical boom 2 through multiple stages. On the other hand, a horizontal boom 5, which is provided on the head of the vertical boom 2 so that it can be derricked, is operated by a horizontal boom derricking cylinder 6. A horizontal boom telescopic cylinder 7, which is a second actuator and is included in the horizontal boom 5 an shown in FIG. 6, telescopically moves the horizontal boom 5 through multiple stages.

Figure 2:
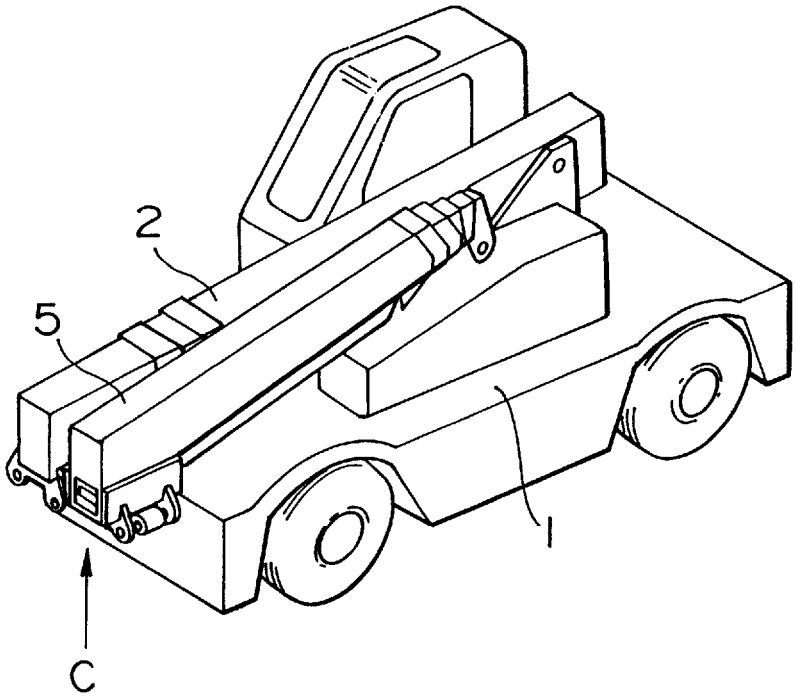
FIG. 2 is a perspective view illustrating a traveling state of the wheel-drive reach tower crane of the embodiment.

As can be seen from FIG. 2, the vertical boom 2 has been laid on the body 1 of the reach tower crane, and the horizontal boom 5 has been pirouetted into a position parallel with a side of the vertical boom 2, so that the field of vision for an operator is not obstructed by the booms 2 and 5.

Figure 3:
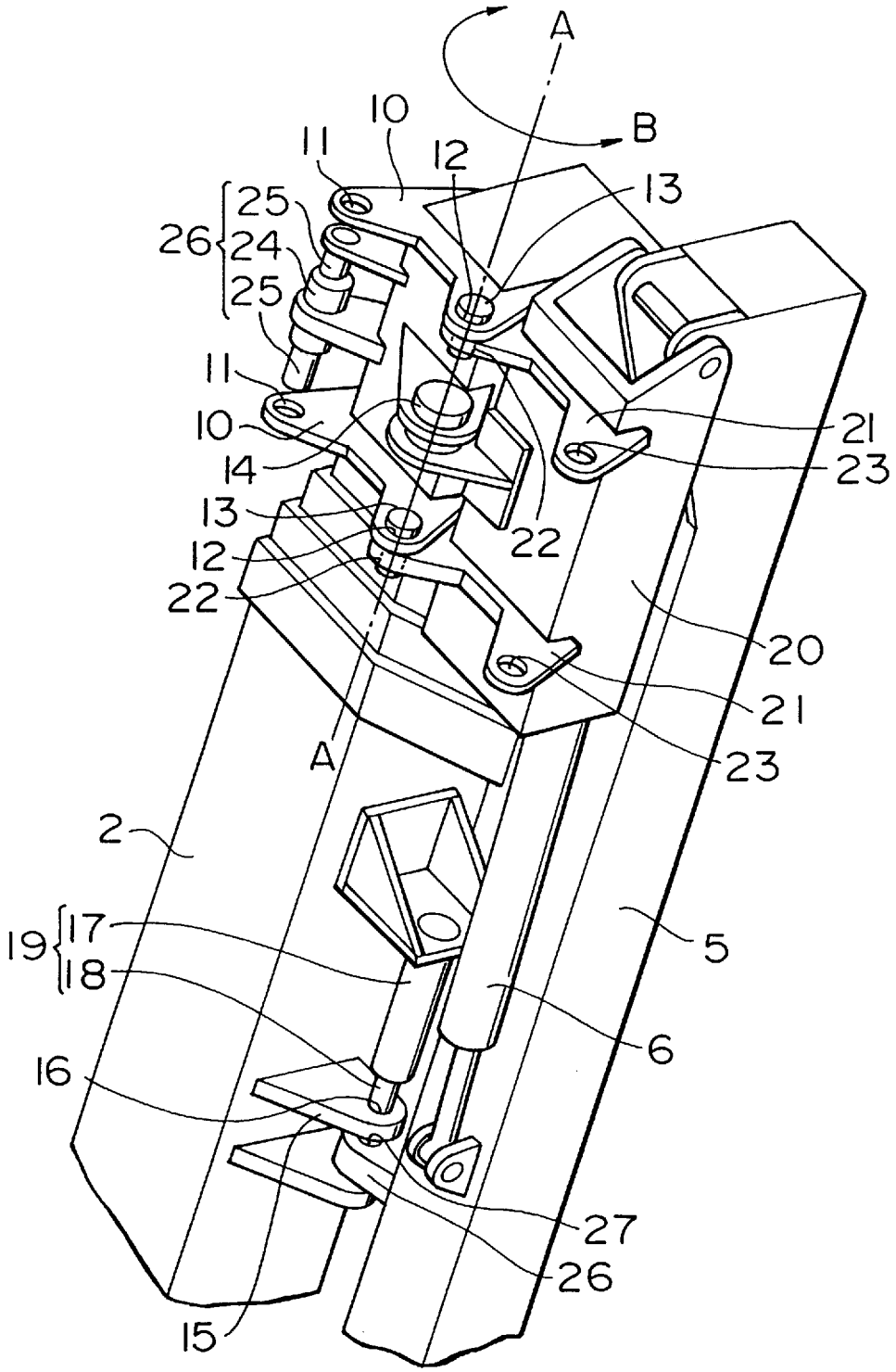
FIG. 3 is a perspective view along the arrow C as shown in FIG. 2, illustrating a coupling part of the horizontal boom and the vertical boom in the reach tower crane.

Referring to FIG. 3, there is shown a coupling part of the horizontal boom 5 and the vertical boom 2. Two axially spaced apart brackets 10 are fixed on the head of the vertical boom 2 in parallel with each other. At the two ends of both brackets 10, there are provided holes 11 and 12, respectively. A joint bracket 20 has two brackets 21 fixed thereon in parallel with each other. At the two ends of both brackets 21, there are provided holes 22 and 23, respectively. Further, the holes 12 in the brackets 10 on the vertical boom 2 and the holes 22 in the brackets 21 on the joint bracket 20 are aligned with each other, and are connected by the pins 13 so that the joint bracket 20 can be pirouetted about the pins 13. A rotary motor 14, which is a third actuator, is provided along the pirouetting axis A—A of the pins 13, and pirouettes the joint bracket 20 as shown by the arrow B. On the vertical boom 2, there is provided the second locking cylinder 24 (the first actuator) of the second locking apparatus, including connecting pins 25 in alignment with the holes 11. The horizontal boom 5 and the horizontal boom derricking cylinder 6 are connected to the joint bracket 20 for derricking. A bracket 26, with a hole 27 therein, is fixed on a side of the horizontal boom 5. As shown in FIG. 3, in a state that the horizontal boom 5 has been pirouetted to a side of the vertical boom 2, the hole 27 in the bracket 26 is aligned with the hole 16 of the bracket 15, fixed on a side of the vertical boom 2. On a side of the vertical boom 2, there is provided the first locking cylinder 17 of the first locking apparatus 19, including a connecting pin 18 in alignment with the hole 16.

Figure 4:
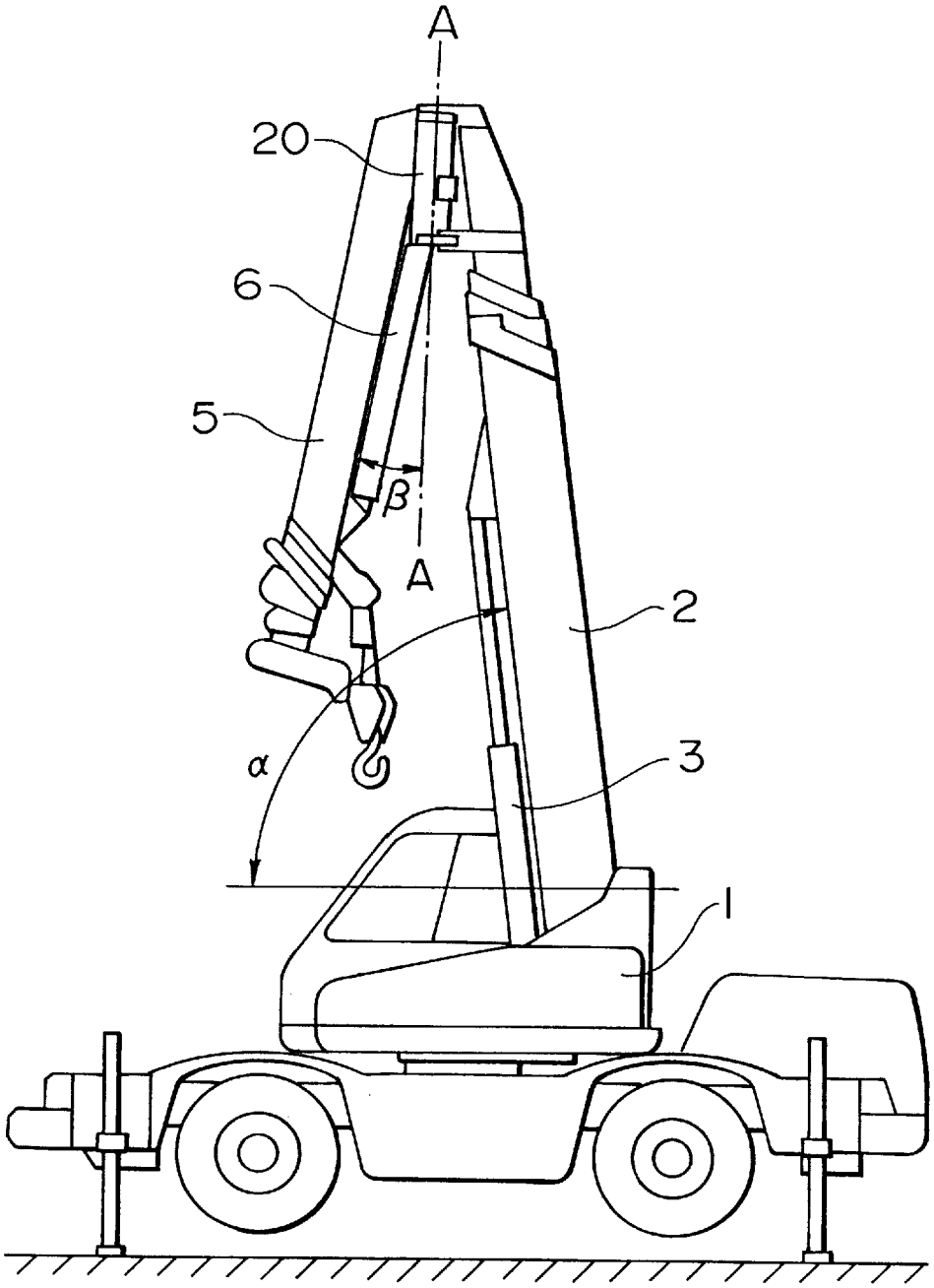
FIG. 4 is a side view illustrating a state of the reach tower crane when starting to store the horizontal boom of the embodiment.

Effects of the present invention are described below. In order for the horizontal boom 5 to be repositioned from the operational state of the reach tower crane as shown in FIG. 1 to being in parallel with a side of the vertical boom 2 as shown in FIG. 2, the vertical boom 2 and the horizontal boom 5 are retracted to their shortest length as shown in FIG. 4, and a derricking angle $\alpha$ of the vertical boom 2 to the horizontal is made to be between 75° and 83°. Thus, the above pirouetting axis A—A is substantially vertical, and the torque required by the rotary motor 14 is minimized. Subsequently, when the angle $\beta$ between the pirouetting axis A—A and the horizontal boom 5 reaches a predetermined value by lowering the horizontal boom 5 using the horizontal boom derricking cylinder 6, the second locking cylinder 24 is operated to disengage the connecting pins 25 from the brackets 10, and thus the rotary motor 14 is driven to pirouette the horizontal boom 5 in the direction of the arrow B as shown in FIG. 3.

When the horizontal boom 5 is positioned in parallel with the vertical boom 2 and the hole 16 of the bracket 15 on the vertical boom 2 is aligned with the hole 27 of the bracket 26 on the horizontal boom 5, the pin 18 is engaged in the holes 16 and 27 by operating the first locking cylinder 17 to secure the vertical boom 2 and the horizontal boom 5 together. Subsequently, the vertical boom 2 is lowered to a storage state as shown in FIG. 2. In order to change from the stored state of the boom to the operational state, the above-described process can be reversed.

Figure 6:
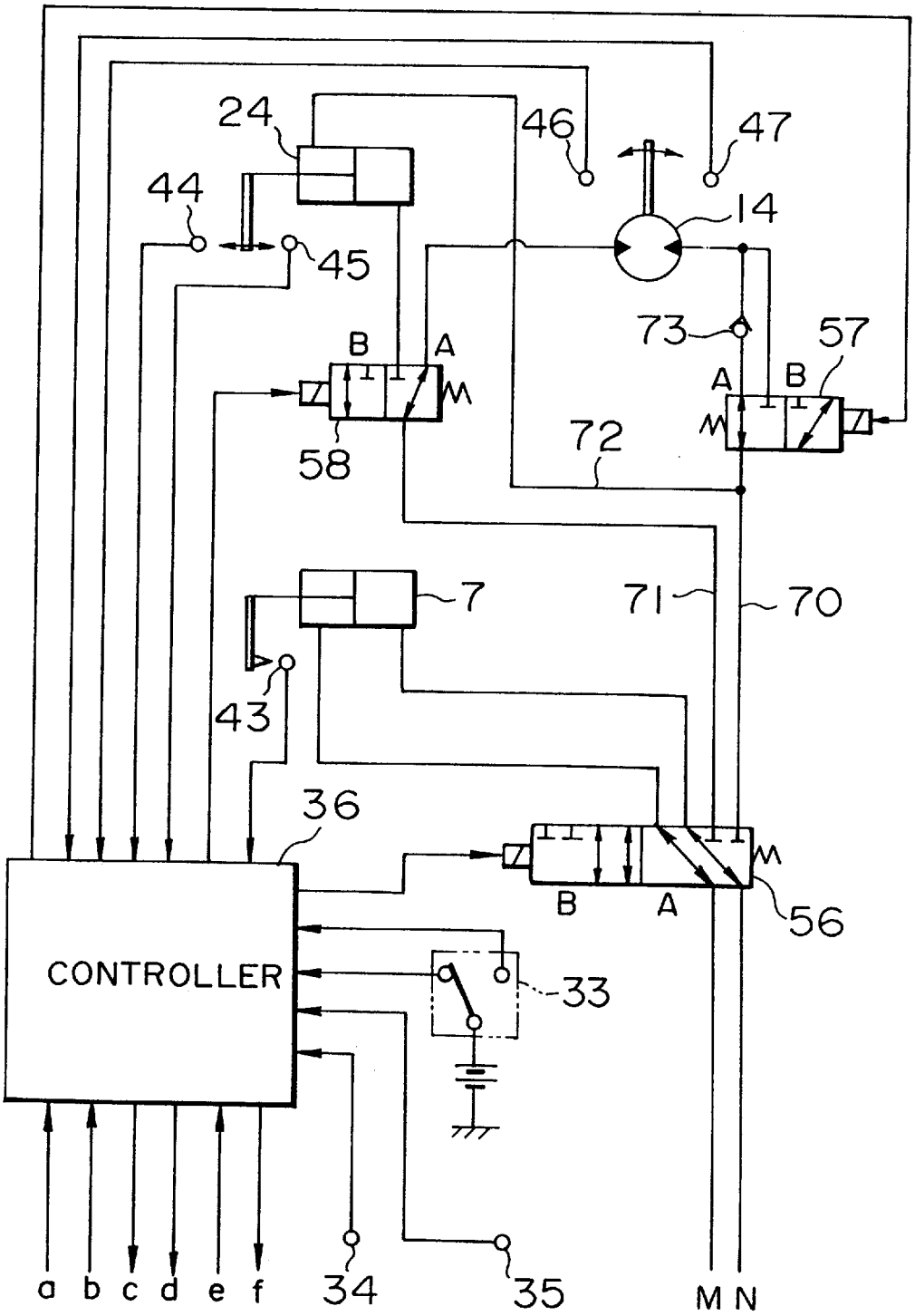
FIG. 6 is a hydraulic circuit connecting to the hydraulic circuit shown in FIG. 5, showing another part of the control system.

Referring to FIG. 5 and FIG. 6, pipes M and N, and lines a, b, c, d, e, and f are respectively connected to another one.

As shown in FIG. 5, there are shown an oil pump 30 and an oil tank 31. The first locking operation switch 32 is manually actuated to operate the first locking cylinder 17, and has the three positions of neutral (N), locking (R), and unlocking (U). The first locking cylinder 17 is provided with a locking completion detection limit switch 40, and an unlocking completion detection limit switch 41. The first locking operation switch 32 is connected both to a locking-unlocking selector valve 50 for the first locking cylinder 17 and to a selector valve 51 to change over between the first locking cylinder 17 and boom operation. The selector valve 51 is provided in a discharge circuit of the pump 30, and the selector valves are all electromagnetic. The selector valve 51, to change over between the first locking cylinder 17 and boom operation, closes a circuit to the first locking cylinder 17 when the first locking operation switch 32 is in the position N, and opens a circuit for boom operation.

There are further shown a boom derricking main operation valve 60 and a boom telescopic motion main operation valve 61, which have manually operated levers 62 and 63. The boom derricking main operation valve 60 controls both the vertical boom derricking cylinder 3 and the horizontal boom derricking cylinder 6, while the boom telescopic motion main operation valve 61 controls both the vertical boom telescopic cylinder 4 and the horizontal telescopic cylinder 7. A vertical boom derricking on-off selector valve 52 is provided in a circuit connecting the vertical boom derricking cylinder 3 and the boom derricking main operation valve 60, while a horizontal boom derricking on-off selector valve 53 is provided in a circuit connecting the horizontal boom derricking cylinder 6 and the boom derricking main operation valve 60.

A vertical boom telescopic motion on-off selector valve 54 is provided in a circuit-connecting the vertical boom telescopic cylinder 4 and the boom telescopic motion main operation valve 61. A selector valve 55, for controlling both the horizontal boom telescopic cylinder 7 and the rotary motor 14, is provided in other output circuits M and N of the boom telescopic motion main operation valve 61. The vertical boom telescopic cylinder 4 is provided with a length detection sensor 42 for detecting that the vertical boom 2 is retracted to its shortest length.

Referring to FIG. 6, there is shown a selector valve 56, which is a first solenoid selector valve, to select the horizontal boom telescopic motion or the rotary motor driving. The selector valve 56 is provided in the circuits M and N. This selector valve 56 is connected both to a circuit connecting with the horizontal boom telescopic cylinder 7 and to rotary motor drive circuits 70 and 71. This horizontal boom telescopic cylinder 7 is provided with a length detection sensor 43. A selector valve 57, which is a second solenoid selector valve, to select an operational state or a storing state in connection with the rotary motor 14, is provided in a circuit connecting the circuit 70 and the rotary motor 14, while a check valve 73 is provided in the position A of the selector valve 57. A branch circuit 72 of the circuit 70 is connected to one chamber of the second locking cylinder 24.

The circuit 71 is connected, both to the other chamber of the second locking cylinder 24 and to the rotary motor 14, through a selector valve 58, which is a third solenoid selector valve, to select the second locking cylinder 24 or the rotary motor 14. On the second locking cylinder 24, there are mounted a locking completion detection limit switch 44 and an unlocking completion detection limit switch 45. On the rotary motor 14, there are mounted a storing completion detection limit switch 46 and an extending completion detection limit switch 47.

A vertical-horizontal selector switch 33 is a manually operated switch to change over between operating the vertical boom 2 and operating the horizontal boom 5. Operating the selector switch 33 changes over the boos derricking main operation valve 60 and the boom telescopic motion main operation valve 61 to be in the vertical boom operation or in the horizontal boom operation. A derricking angle detection sensor 34 detects a derricking angle of the vertical boom 2, and a derricking angle detection sensor 35 detects that of the horizontal boom 5. A controller 36 connects with the limit switches 40 to 47, the derricking angle detection sensors 34 and 35, and the selector switch 33. The controller 36 receives their input, and connects with the selector valves 52 to 58 to send control signals thereto.

Figure 7:
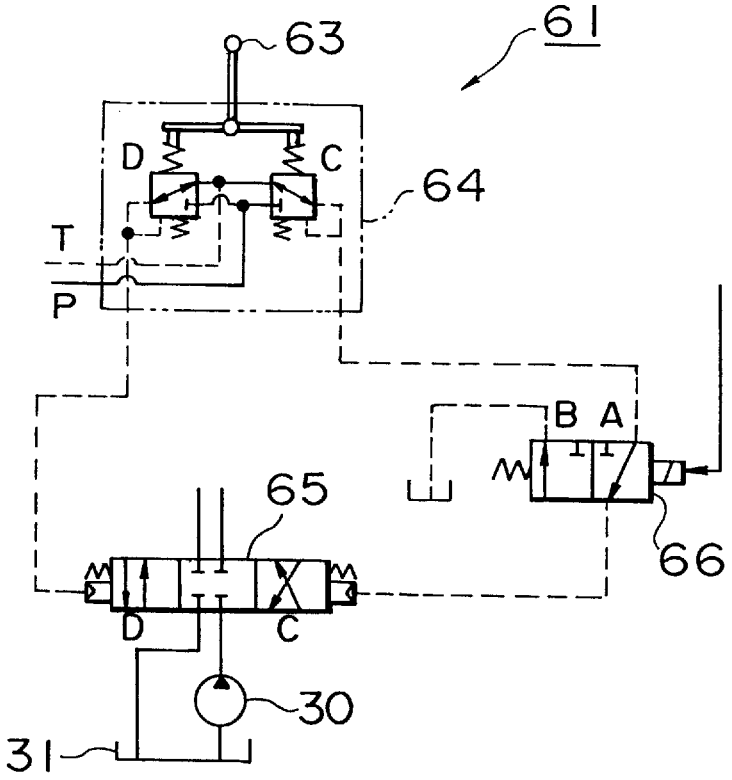
FIG. 7 is a detail hydraulic circuit of a main operating valve for telescopically moving the booms of the embodiment.

Referring to FIG. 7, the boom telescopic notion main operation valve 61 is pilot-controlled, and has therein an unloader valve 66 provided in one of circuits connecting both a pilot control valve, equipped with the operation lever 63 to telescopically move the boom, and a directional control valve 65. The unloader valve 66 is connected to the controller 36. There are further shown the hydraulic pump 30 and the oil tank 31. Operating the operation lever 63 to the side C of the pilot control valve 64 enables the directional control valve 65 to move in the position C so that the boom is extended; oppositely, operating the operation lever 63 to the sidle D enables the directional control valve 65 to move in the position D so that the boom is retracted.

Explaining the operation of the main operation valve 61, the unloader valve 66 is normally in the position A by a signal from the controller 36 so as to enable both operations of extending and retracting the boom. However, when operating the boom to be extended, stored, or locked, a malfunction of the limit switch or the like causes the controller 36 to detect an abnormal state and to send a control signal to move the unloader valve 66 to the position B. The directional control valve 65 accordingly can move to the position D, but cannot move to the position C. In other words, since the boom can be retracted but cannot be extended, stability during the malfunction of the limit switch or the like is maintained.

Figure 8:
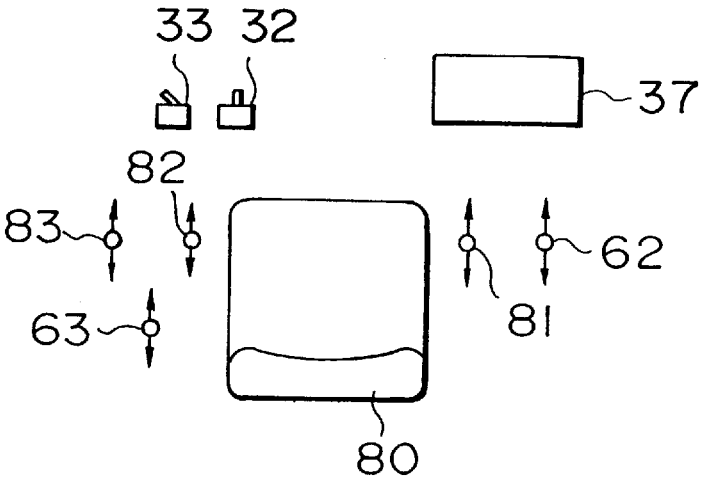
FIG. 8 is a configurative view illustrating operation levers, operation switches, and so on, provided in a cab of the reach tower crane of the embodiment.

Referring to FIG. 8, to the right of an operator seat 80, there are provided the boom derricking operation lever 62 and an auxiliary winch operation lever 81, while to the left of the seat 80, there are provided the main winch operation lever 82, the swing operation lever 83, and the boom telescopic operation lever 63. On the other hand, in front of the seat 80, there are provided the first locking operation switch 32, the vertical-horizontal selector switch 33, and an indicator panel 37. In accordance with signals from the controller 36, the indicator panel 37 indicates the completion of locking or unlocking by the first locking apparatus 19, the completion of unlocking by the second locking apparatus 26, the completion of storing by the rotary motor 14, the derricking angles of the vertical boom 2 and the horizontal boom 5, and the completion of the retraction of both the vertical boom 2 and the horizontal boom 5 to their shortest lengths.

Figure 9:
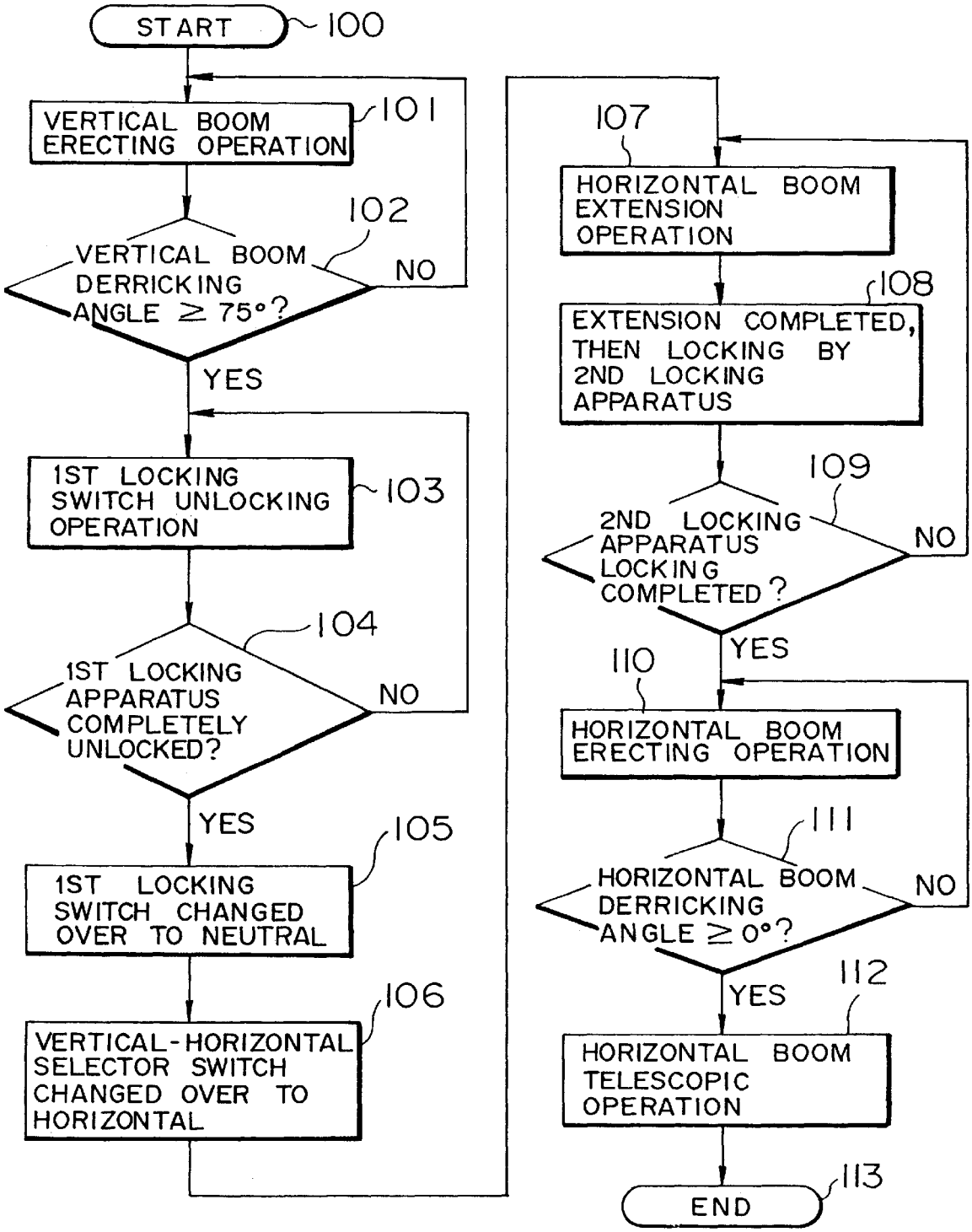
FIG. 9 is a flow chart showing a first method of operation for extending the horizontal boom of the embodiment.

The operation of extending and storing the horizontal boom 5 is described using the flow chart of FIG. 9, based on the circuits in FIG. 5 and FIG. 6, as follows:

In Step 100 as an initial state, the horizontal boom 5 is in a stored condition, and the vertical-horizontal selector switch 33 is in the state for operating the vertical boom 2. Consequently, the selector valves 52 and 54 are in their position A, while the selector valves 53 and 55 are in their position B. The first locking apparatus 19 is in its locked state, the first locking operation switch 32 is in its position N, and the selector valve 51 is in its position A. A derricking angle of the horizontal boom 5 shows a maximum angle of lowering. The selector valve 56 has been changed over to its position B by a signal sent from the controller 36. The second locking apparatus 26 is in its unlocked state and the selector valve 57 is in its position B, based on a signal from the limit switch 45.

In Step 101, an operator erects the vertical boom 2 by operating the boom derricking operation lever 62. In the following Step 102, the operator verifies, from the indicator panel 37, whether or not a derricking angle of the vertical boom 2 is greater than 75°, based on a signal from the derricking angle sensor 34. If the angle is equal to or greater than 75°, the operator proceeds to the following Step 103. If not, the operator returns to the Step 101.

In Step 103, the operator changes over the first locking switch 32 to its position U. Then, the selector, valves 50 and 51 change over to their position B. Pressurized oil from the hydraulic pump 30 moves the first locking cylinder 17 to enable unlocking by the first locking apparatus 19. In Step 104, the operator verifies, from the indicator panel 37, whether or not the unlocking by the first locking apparatus 19 is completed, based on a signal from the limit switch 41. If the unlocking is completed, the operator proceeds to the following Step 105. If not, the operator returns to the Step 103.

In Step 105, the operator changes over the first locking switch 32 to its position N, then the selector valve 51 changes over to its position A. In Step 106, the operator changes over the vertical-horizontal selector switch 33 to horizontal. Then, the selector valves 52 and 54 change over to their position B, and the selector valve 55 changes over to its position A. In Stop 107, the operator operates the boom telescopic motion lover 63 in the extending direction. The pressurized oil from the oil pump 30 passes through the circuits 70 and 71 and the selector valves 55, 56, 57, and 58 to drive the rotary motor 14 in the pirouetting direction.

In Step 108, when the rotary motor 14 has turned a predetermined angle, whereby extending the horizontal boom 5 is completed, and a signal from the limit switch 47 is inputted to the controller 36, the controller 36 sends control signals to change over the selector valve 57 to its position A, and to change over the selector valve 58 to its position B. The pressurized oil passes through the circuits 71 and 72 and the selector valve 58 to move the second locking cylinder 24, so as to secure the pin 25 in the joint bracket 20 on the vertical boom 2.

In Step 109, the operator verifies, from the indicator panel 37, whether or not the locking by the second locking apparatus 26 is completed, based on a signal from the limit switch 44. If the locking is completed, the operator proceeds to the following Step 110. If not, the operator returns to the Step 107. When the locking by the second locking apparatus 26 is completed, based on a signal from the limit switch 44, the selector valve 53 changes over to its position A, so that the horizontal boom derricking cylinder 6 becomes operational. In Step 110, the operator operates the derricking operation lever 62 to erect the horizontal boom 5.

In Step 111, the operator verifies whether or not an angle of the horizontal boom 5 with respect to ground is equal to or greater than 0°, based on a signal from the derricking angle sensor 35. If the angle is equal to or greater than 0°, the operator proceeds to the following Step 112. If not, the operator returns to Step 110. When the controller 36 receives a signal from the derricking angle detection sensor 35 that the angle of the horizontal boom 5 with respect to ground is equal to or greater than 0°, the controller 36 sands control signals to change over the selector valve 56 to its position A, so that the horizontal boom telescopic cylinder 7 becomes operational. In Step 112, the operator operates to telescopically move the horizontal boom 5. In Step 113, extending the horizontal boom 5 is completed.

Figure 10:
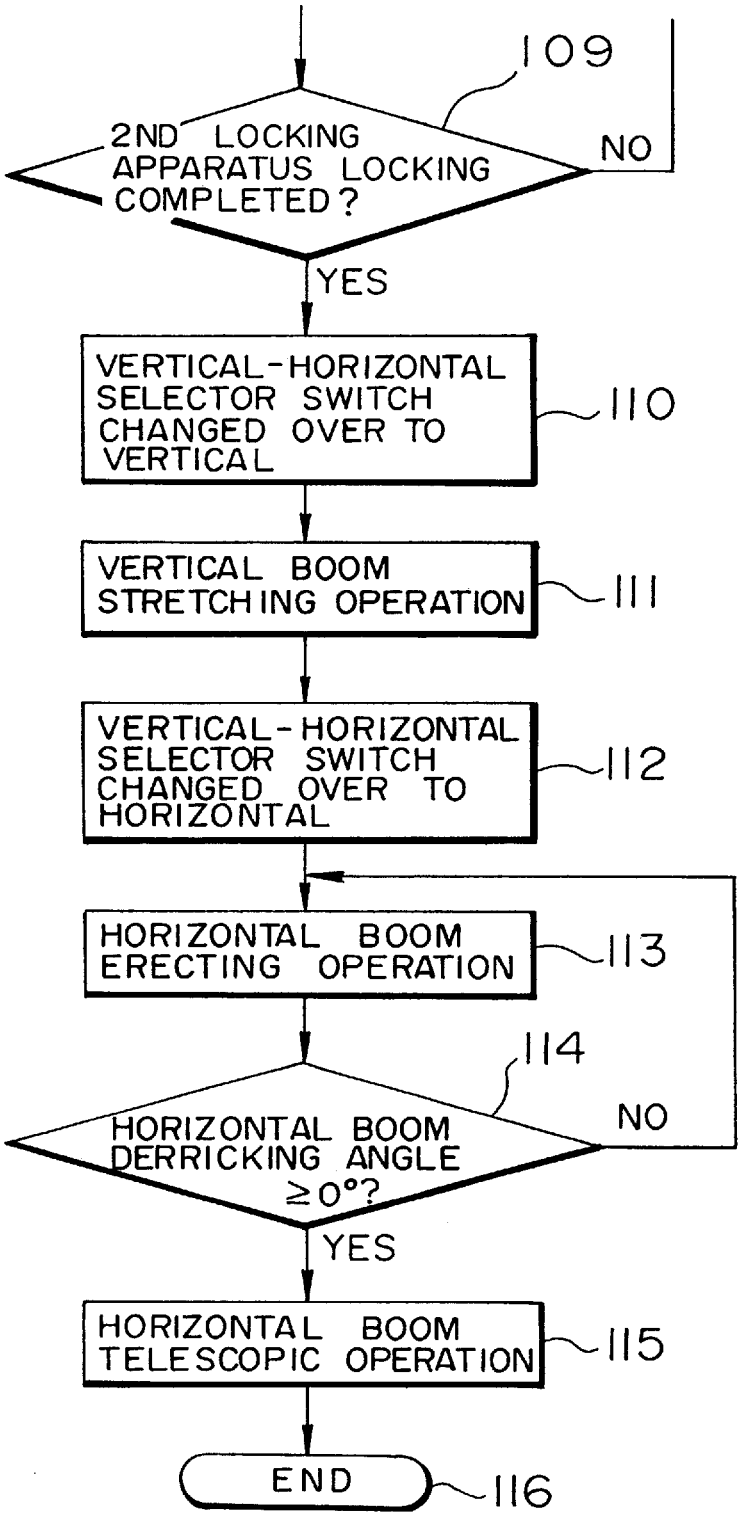
FIG. 10 is a flow chart showing a second method of operation for extending the horizontal boom of the embodiment.

FIG. 10 is a flow chart showing a second method for the operation of extending, which is the same as the above-described first method through the Step 108. Explanation of the same steps are accordingly omitted.

In Step 109, the operator verifies, from the indicator panel 37, whether or not the locking by the second locking apparatus 26 is completed, based on a signal from the limit switch 44 of the second locking cylinder 24. If the locking is completed, the operator proceeds to the following Step 110. If not, the operator returns to the Step 107. When the locking by the second locking apparatus 26 is completed, based on a signal from the limit switch 44, the selector valve 53 changes over so that the horizontal boom derricking cylinder 6 becomes operational.

In Step 110, the operator changes over the vertical-horizontal selector switch 33 to its vertical mode position. Then, the selector valves 52 and 54 change over to their position A, while the selector valves 53 and 55 change over to their position B. In Step 111, the operator operates the boom telescopic motion lever 63 to extend the vertical boom 2. In Step 112, the operator changes over the vertical-horizontal selector switch 33 to its horizontal mode position. Then, the selector valves 53 and 55 change over to their position A, while the selector valves 52 and 54 change over to their position B.

In Step 113, the operator operates the boom derricking operation lever 62 to erect the horizontal boom 5. In Step 114, the operator verifies whether a derricking angle of the horizontal boom 5 with respect to ground is equal to or greater than Of or not. If the angle is equal or greater, the operator proceeds to the following Step 115. If not, the operator returns to the Step 113. On receiving a signal from the derricking angle detection sensor 35 that the derricking angle of the horizontal boom 5 with respect to ground is equal to or greater than 0°, the controller 36 sends a control signal to change over the selector valve 56, so that the horizontal boom telescopic cylinder 7 becomes operational. In Step 115, the operator operates to telescopically move the horizontal boom 5. In Step 116, extending the horizontal boom 5 is completed.

In accordance with the second method, easy operation of erecting the horizontal boom can be realized in a limited space.

Figure 11:
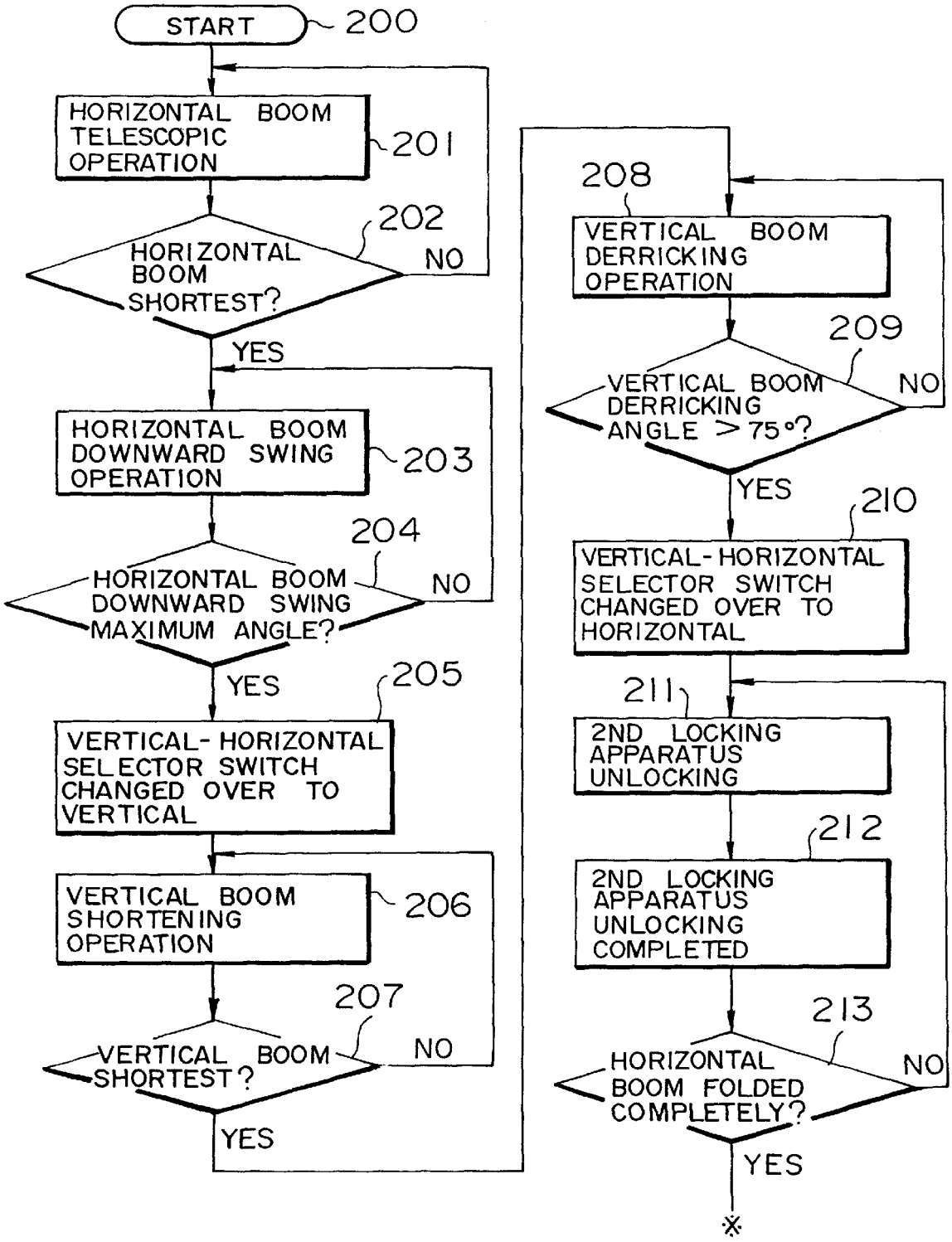
FIG. 11 is the first half of a flow chart showing an operation for storing the horizontal boom of the embodiment.
Figure 12:
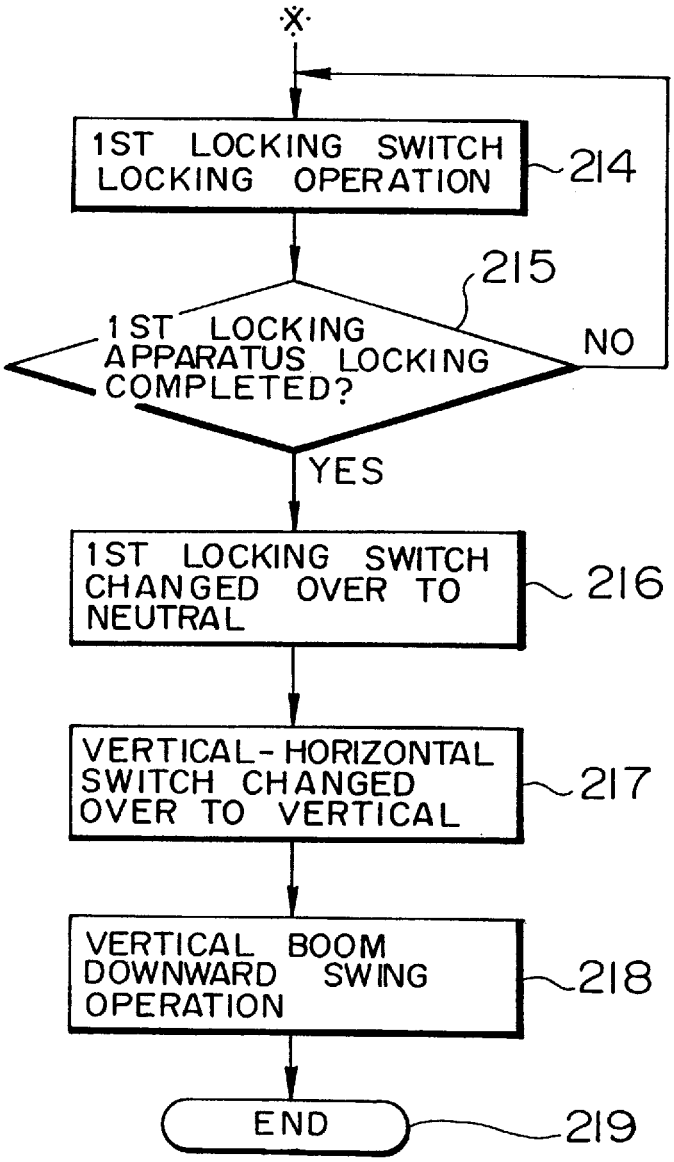
FIG. 12 is the latter half of the flow chart, connected to the first half of FIG. 11, showing the operation of storing the horizontal boom of the embodiment.

The operation of storing the horizontal boom 5 is described in accordance with the flow charts of FIG. 11 and FIG. 12, as follows:

In initial Step 200, the vertical boom 2 is in an erected and extended working state and the horizontal boom 5 is in an erected and extended state. On the other hand, the vertical-horizontal selector switch 33 is in the state for operating the horizontal boom. Consequently, the selector valves 53 and 55 are in their position B, while the selector valves 53, 55 and 56 are in their position A. The first locking cylinder 17 is in its unlocking state, the first locking operation switch 32 is in its position N, the selector valve 50 is in its position B, and the selector valve 51 is in its position A. On the other hand, the second locking cylinder 24 is in its locking state, and the selector valve 57 is in its position A and the selector valve 58 is in its position B, based on a signal from the limit switch 44.

In Step 201, the operator operates the boom telescopic operation lever 63 to actuate the horizontal boom telescopic cylinder 7 so as to retract the horizontal boom 5. In Step 202, the operator verifies, from the indicator panel, whether or not the horizontal boom 5 is retracted to its shortest length, based on a signal from the length detection sensor 43. If the horizontal boom 5 is fully retracted, the operator proceeds to the following Step 203. If not, the operator returns to the Step 201. In Step 203, the operator operates the boom derricking operation lever 62 to actuate the horizontal boom derricking cylinder 6 so as to lower the horizontal boom 5.

In Step 204, the operator verifies, from the indicator panel 37, whether or not the horizontal boom 5 is at a maximum angle of lowering, based on a signal from the derricking angle detection sensor 35. If the horizontal boom 5 is at the maximum angle, the operator proceeds to the following Step 205. If not, the operator returns to the Step 203. When the horizontal boom 5 is at the maximum angle, as evidenced by a signal from the derricking angle detection sensor 35, the controller 36 sends a control signal to change over the selector valve 56 to its position B. In Step 205, the operator changes over the vertical-horizontal selector switch 33 to the vertical.

In Step 206, the operator operates the boom telescopic operation lever 63 to actuate the vertical boom telescopic cylinder 4 so as to retract the vertical boom 2. In Step 207, the operator verifies, from the indicator panel 37, whether or not the vertical boom is retracted to its shortest length. If the vertical boom is at its shortest length, the operator proceeds to the following Step 208. If not, the operator returns to the Stop 206. In the Step 208, the operator operates the boom derricking operation lever 62 so that a derricking angle of the vertical boom 2 can be greater than 75°. In Step 209, the operator verifies, from the indicator panel 37, whether or not the derricking angle of the vertical boom 2 is greater than 75°, based on a signal from the derricking angle detection sensor 34. If the derricking angle is greater, the operator proceeds to the following Step 210. If not, the operator returns to the Step 208.

In Step 210, the operator changes over the vertical-horizontal selector switch to the horizontal. In Step 211, when the operator operates the boom telescopic operation lever 63 to the direction of unlocking by the second locking apparatus 26, pressurized oil from the oil pump 30 passes through the circuits 70, 71 and 72 and the selector valves 55, 56 and 58 to actuate the second locking cylinder 24 so as to enable unlocking by the second locking apparatus 26. On the other hand, the passing of oil from the circuit 70 to the rotary motor 14 via the selector valve 57 is blocked by the check valve 73.

In Step 212, when the piston of the second locking cylinder 24 is fully retracted to enable unlocking by the second locking apparatus 26, based on a signal from the limit switch 45, the controller 36 sends control signals to change over the selector valves 53 and 57 to their position B and to change over the selector valve 58 to its position A. Pressurized oil passes through the circuits 70 and 71 and the selector valves 57 and 58 to drive the rotary motor 14 in the pirouetting direction. In Step 213, the operator verifies, from the indicator panel 37, whether or not the rotary motor 14 has turned a predetermined angle, based on a signal from the limit switch 46. If the rotary motor 14 has turned at that angle, the operator proceeds to the following Step 214. If not, the operator returns to the Step 211.

In Step 214, the operator changes over the first locking switch 32 to its position R. The selector valve 50 changes over to its position A, and the selector valve 51 changes over to its position B. Pressurized oil passes via the selector valves 50 and 51 to actuate the first locking cylinder 17 so as to enable locking by the first locking apparatus 19. In Step 215, the operator verifies, from the indicator panel 37, whether or not the locking by the first locking apparatus 19 is completed, based on a signal from the limit switch 41. If the locking is completed, the operator proceeds to the following Step 216. If not, the operator returns to the Step 214.

In Step 216, the operator changes over the first locking operation switch 32 to its position N, and changes over the selector valve 51 to its position A.

In Step 217, the operator changes over the vertical-horizontal selector switch 33 to its vertical mode position. The selector valves 52 and 54 change over to their position A, and the selector valves 53 and 55 change over to their position B. In Step 218, the operator operates the boom derricking operation lever 62 to lower the vertical boom 2. In Step 219, the storing is completed.

Figure 13:
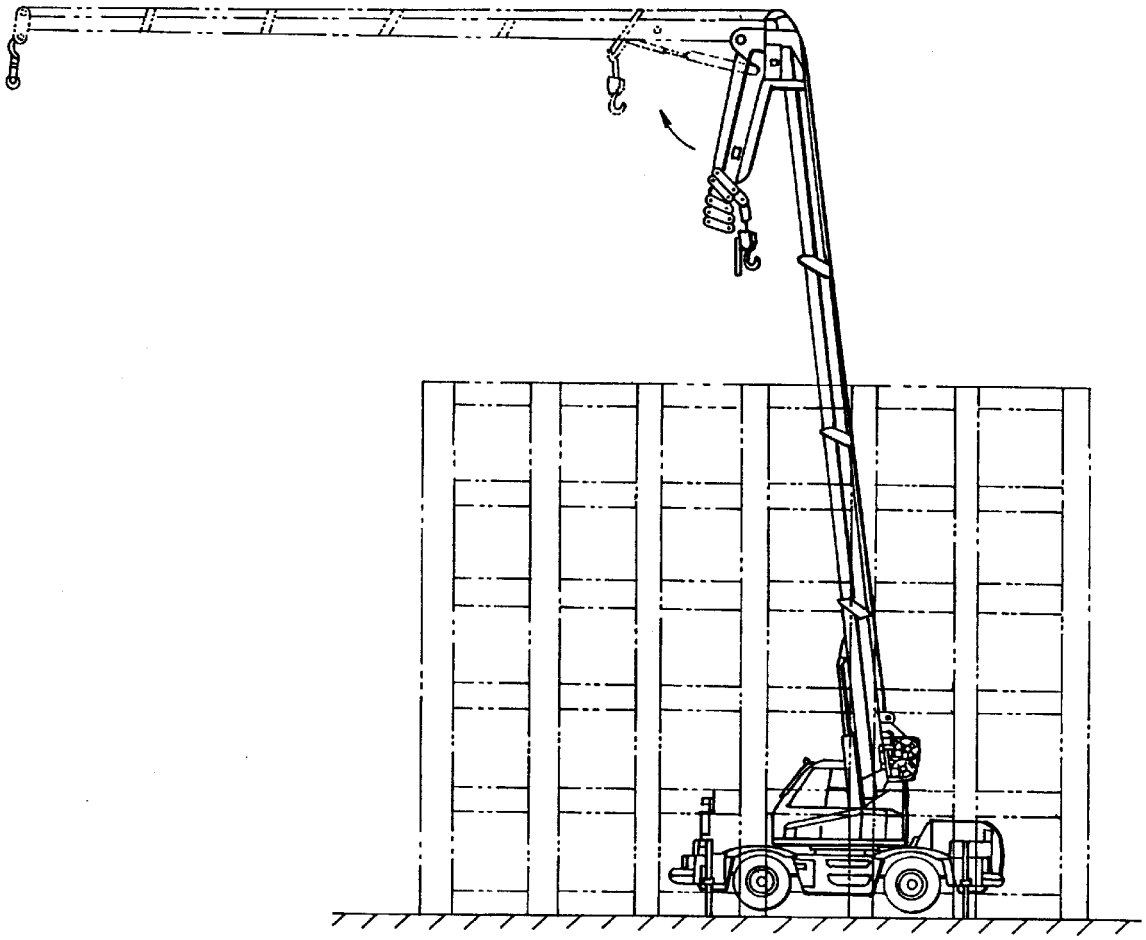
FIG. 13 is an explanatory side view illustrating the reach tower crane erecting and telescopically moving the horizontal boom after extending the vertical boom.

Referring to FIG. 13, there is shown an embodiment of the operation control method of the reach tower crane for erecting and telescopically moving the horizontal boom after extending the vertical boom, in a place where a building or the like is in proximity to the crane.

As stated in the foregoing, the present invention comprises components as described above, and is such that a subsequent operation starts after verifying the operation of each actuator by using each sensor. In accordance with the present invention, one operator in the crane cab is able to safely and firmly operate or store the horizontal boom, and to operate the crane to work in a limited space. The present invention further providers the operation control apparatus and method for extending or storing the horizontal boom without losing stability of the crane.

INDUSTRIAL APPLICABILITY

The present invention is useful as the apparatus and a method for controlling the operation of a reach tower crane in which the horizontal boom can safety and firmly be operated or stored by one operator, the crane can be operated in a limited space, and the stability of the crane cannot be lost when a part such as a sensor is out of order.

We claim:

1. A system for controlling an operation of a reach tower crane having a cab, a vertical boom capable of biting derricked and telescopically moved in multiple stages, and a swingable horizontal boom connected with a head of said vertical boom so that the horizontal boom can be telescopically moved in multiple stages and be derricked, wherein said horizontal boom can be pirouetted in a widthwise direction of said vertical boom from an operational position to a storage position parallel to a side of said vertical boom, said system comprising:

a plurality of actuators, each of said actuators operating a respective apparatus, one of said actuators being a rotary motor;

a plurality of sensors for detecting conditions of said actuators;

a controller for receiving signals from said plurality of sensors and for providing control signals to said actuators in accordance with the signals from said sensors, whereby each said apparatus is operated in accordance with a control signal provided by said controller;

a first locking apparatus for securing said vertical boom and said horizontal boom together when said horizontal boom is in said storage position parallel to said side of said vertical boom;

a second locking apparatus for securing said horizontal boom with respect to said head of said vertical boom when said horizontal boom is in said operational position;

a single telescopic operation lever, positioned in said cab, for selectively controlling a telescopic motion of said vertical boom, a telescopic notion of said horizontal boom, an operation of said rotary motor, and an operation of said second locking apparatus;

a single derricking operation lever, positioned in said cab, for selectively controlling derricking of said vertical boom and derricking of said horizontal boom;

a selector switch, positioned in said cab, for selecting between control of said vertical boom and control of said horizontal boom; and an operation switch, positioned in said cab, for operating said first locking apparatus.

2. A system in accordance with claim 1, wherein said horizontal boom is pivotally connected to a joint bracket, wherein one side of said joint bracket is pivotally connected to said head of said vertical boom so that said joint bracket and said horizontal boom can pirouette about said one side of said joint bracket in a widthwise direction of said vertical boom between said operational position and said storage position, and wherein said second locking apparatus can secure to said head of said vertical boom a side of said joint bracket which is opposite to said one side.

3. A system in accordance with claim 1, wherein said plurality of actuators includes a first hydraulic actuator for providing telescopic motion of said horizontal boom so as to extend or retract said horizontal boom, and a second hydraulic actuator for providing telescopic motion of said vertical boom so as to extend or retract said vertical boom;

wherein said plurality of sensors comprises sensors for detecting conditions of said first and second hydraulic actuators;

a hydraulic circuit for controlling said first and second hydraulic actuators, an unloader valve being contained in said hydraulic circuit, said unloader valve having an operational position and an unloading position, whereby said unloader valve being in its unloading position prevents extension of either of said vertical boom and said horizontal boom while permitting retraction of either of said vertical boom and said horizontal boom; and wherein said controller actuates said unloader valve to its unloading position when one of said sensors is out of order.

4. A system in accordance with claim 3, wherein said hydraulic circuit further comprises:

a three position valve for selectively providing pressurized oil to said first and second hydraulic actuators;

a manually actuatable lever for selecting between a boom retraction operation, in which a pilot signal is applied to one end of said three position valve to move said three position valve in a first direction, and a boom extension operation, in which a pilot signal is either blocked by said unloading position of said unloading valve or applied through said operational position of said unloader valve to a second end of said three position valve to move said three position valve in a second direction opposite to said first direction, whereby said unloader valve being in its unloading position prevents movement of said three position valve to one of the positions of said three position valve and thereby prevents extension of either of said vertical boom and said horizontal boom while permitting retraction of either of said vertical boom and said horizontal boom.

5. A system for controlling an operation of a reach tower crane having a cab, a vertical boom capable of being derricked and telescopically moved in multiple stages, and a swingable horizontal boom connected with a head of said vertical boom so that the horizontal boom can be telescopically moved in multiple stages and be derricked, wherein said horizontal boom can be pirouetted in a widthwise direction of said vertical boom from an operational position to a storage position parallel to a side of said vertical boom, said system comprising:

a first hydraulic actuator for providing telescopic notion of said vertical boom so as to extend or retract said vertical boom;

a second hydraulic actuator for providing telescopic motion of said horizontal boom so as to extend or retract said horizontal boom;

a plurality of sensors for detecting conditions of said actuators;

a hydraulic circuit for controlling said first find second hydraulic actuators, an unloader valve being contained in said hydraulic circuit, said unloader valve having an operational position and an unloading position, whereby said unloader valve being in its unloading position prevents extension of either of said vertical boom and said horizontal boom while permitting retraction of either of said vertical boom and said horizontal boom; and a controller for receiving signals from said plurality of sensors and for providing control signals to said actuators in accordance with the signals from said sensors, and for actuating said unloader valve to its unloading position when one of said sensors is out of order.

6. A system in accordance with claim 5, wherein said hydraulic circuit further comprises:

a three position valve for selectively providing pressurized oil to said first and second hydraulic actuators;

a manually actuatable lever for selecting between a boom retraction operation, in which a pilot signal is applied to one end of said three position valve to move said three position valve in a first direction, and a boom extension operation, in which a pilot signal is either blocked by said unloading position of said unloading valve or applied through said operational position of said unloader valve to a second end of said three position valve to move said three position valve in a second direction opposite to said first direction, whereby said unloader valve being in its unloading position prevents movement of said three position valve to one of the positions of said three position valve and thereby prevents extension of either of said vertical boom and said horizontal boom while permitting retraction of either of said vertical boom and said horizontal boom.

7. A system for controlling an operation of a reach tower crane having a cab, a vertical boom capable of being derricked and telescopically moved in multiple stages, and a swingable horizontal boom connected with a head of said vertical boom so that the horizontal boom can be telescopically moved in multiple stages and be derricked, wherein said horizontal boom can be pirouetted in a widthwise direction of said vertical boom from an operational position to a storage position parallel to a side of said vertical boom, said system comprising:

a coupling pin having a locked position, for locking said horizontal boom to said vertical boom when said horizontal boom is in its operational position, and an unlocked position;

an operational position detection sensor for detecting that said horizontal boom is in its operational position;

a storing completion detection sensor for detecting that said horizontal boom is in its storage position;

an unlocking completion detection sensor for detecting that said coupling pin is in its unlocked position;

a first actuator for actuating said coupling pin between its locked position and its unlocked position;

a second actuator for effecting telescopic movement of said horizontal boom;

a third actuator for pirouetting said horizontal boom between its operational position and its storage position;

a three position operating valve for boom telescopic notion, said three position operating valve having a hydraulic power source port, a tank port, a first actuator port, and a second actuator port;

first, second, and third solenoid selector valves;

said first solenoid selector valve having a first position and a second position, whereby in said first position said first solenoid selector valve connects one of said first and second actuator ports to both said second solenoid selector valve and said first actuator and connects the other of said first and second actuator ports to said third solenoid selector valve, and whereby in said second position said first solenoid selector valve connects said first and second actuator ports to said second actuator;

said second solenoid selector valve having a first position and a second position, whereby in its first position said second solenoid selector valve connects said first solenoid selector valve to said third actuator, and whereby in its second position said second solenoid selector valve connects said second solenoid selector valve to a check valve to block any flow from said first solenoid selector valve through said second solenoid selector valve to said third actuator;

a third solenoid selector valve having a first position and a second position, whereby in its first position said third solenoid selector valve connects said first solenoid selector valve to said first actuator, and whereby in its second position said third solenoid selector valve connects said first solenoid selector valve to said third actuator;

a controller for receiving a signal from each of said sensors and for transmitting a control signal to each of said solenoid selector valves.

8. A system in accordance with claim 7, wherein said controller, said solenoid selector valves and said actuators have a relationship such that when said horizontal boom is to be moved from its storage position to its operational position, said controller transmits a control signal to said first solenoid selector valve to move said first solenoid selector valve to its first position to pass pressurized oil through said first solenoid selector valve to said second solenoid selector valve and transmits a control signal to said second solenoid selector valve to move said second solenoid selector valve to its first position to pass pressurized oil from said second solenoid selector valve to said third actuator to drive said third actuator to pirouette said horizontal boom toward its operational position until said operational position detection sensor provides to said controller a signal, representative of said horizontal boom being in its operational position, so that said controller then transmits a control signal to said third solenoid selector valve to cause said third solenoid selector valve to changeover to its first position so as to enable pressurized oil from said first solenoid selector valve to drive said first actuator via the first position of said third solenoid selector valve to move said coupling pin to its locked position, thereby locking said vertical boom and said horizontal boom together with said horizontal boom being in its operational position.

9. A system in accordance with claim 8, wherein said controller, said solenoid selector valves and said actuators have a relationship such that when said horizontal boom is to be moved from its operational position to its storage position, said controller transmits a control signal to said first and third solenoid selector valves to move said first solenoid selector valve to its first position and to move said third solenoid selector valve to its first position to pass pressurized oil through the first position of said first solenoid selector valve to said first actuator and to return oil from said first actuator through the first position of said third solenoid selector valve to thereby drive said first actuator to move said coupling pin to its unlocked position, the movement of said coupling pin to its unlocked position being detected by said unlocking completion detection sensor which provides a signal to said controller which in turn then transmits a control signal to said third solenoid selector valve to causes a changeover of said third solenoid selector valve to its second position, so that pressurized oil then drives said third actuator until said storing completion detection sensor provides a signal to the controller verifying, that said horizontal boom is in its storage position.

10. A system in accordance with claim 9, wherein said controller, said solenoid selector valves and said actuators have a relationship such that when said horizontal boom is in its operational position and is to be extended, said controller transmits a control signal to said first solenoid selector valve to move said first solenoid selector valve to its second position to thereby pass pressurized oil from said first solenoid selector valve to said second actuator to thereby telescopically move said horizontal boom.

11. A system in accordance with claim 7, wherein said controller, said solenoid selector valves and said actuators have a relationship such that when said horizontal boom is to be moved from its operational position to its storage position, said controller transmits a control signal to said first and third solenoid selector valves to move said first solenoid selector valve to its first position and to move said third solenoid selector valve to its first position to pass pressurized oil through the first position of said first solenoid selector valve to said first actuator and to return oil from said first actuator through the first position of said third solenoid selector valve to thereby drive said first actuator to move said coupling pin to its unlocked position, the movement of said coupling pin to its unlocked position being detected by said unlocking completion detection sensor which provides a signal to said controller which in turn then transmits a control signal to said third solenoid selector valve to cause a changeover of said third solenoid selector valve to its second position, so that pressurized oil then drives said third actuator until said storing completion detection sensor provides a signal to the controller verifying that said horizontal boom is in its storage position.

12. A system in accordance with claim 7, wherein said controller, said solenoid selector valves and said actuators have a relationship such that when said horizontal boom is in its operational position and is to be extended, said controller transmits a control signal to said first solenoid selector valve to move said first solenoid selector valve to its second position to thereby pass pressurized oil from said first solenoid selector valve to said second actuator to thereby telescopically move said horizontal boom.

13. A system in accordance with claim 7, wherein said second actuator for effecting telescopic movement of said horizontal boom is a first hydraulic actuator for extending and retracting said horizontal boom; further comprising a second hydraulic actuator for affecting telescopic movement of said vertical boom by extending and retracting said vertical boom;

a hydraulic circuit for controlling said first and second hydraulic actuators, said hydraulic circuit including said three position operating valve, said three position operating valve having a first position by which either one of said first and second hydraulic actuators can be activated in a first direction to extend the respective boom, said three position operating valve having a second position by which either one of said first and second hydraulic actuators can be activated in a second direction to retract the respective boom;

an unloader valve having an operational position and an unloading position, a manually actuatable lever for selecting between a boom retraction operation, in which a pilot signal is applied to one end of said three position valve to move said three position valve in a first direction, and a boom extension operation, in which a pilot signal is either blocked by said unloading position of said unloading valve or applied through said operational position of said unloader valve to a second end of said three position valve to move said three position valve in a second direction opposite to said first direction, whereby said unloader valve being in its unloading position prevents extension of either of said vertical boom and said horizontal boom while permitting retraction of either of said vertical boom and said horizontal boom; and wherein said controller actuates said unloader valve to its unloading position when one of said sensors is out of order.

14. A system in accordance with claim 7, wherein said first solenoid selector valve is moved to its first position when said first solenoid selector valve is excited and said first solenoid selector valve is moved to its second position when said first solenoid selector valve is degaussed, wherein said second solenoid selector valve is moved to its first position when said second solenoid valves is excited and said second solenoid selector valve is moved to its second position when said second solenoid selector valve is degaussed, and wherein said third solenoid selector valve is moved to its first position when said third solenoid valve is excited and said third solenoid selector valve is moved to its second position when said third solenoid selector valve is degaussed.

15. A system in accordance with claim 7, wherein said first actuator is a locking cylinder for driving said coupling pin, said locking cylinder having a locking position at one end and an unlocking position at another and;

wherein said second actuator is a horizontal boom telescopic cylinder; and wherein said third actuator is a rotary motor having an operational position in one direction and a storage position in an opposite direction.

16. A method for controlling an operation of a reach tower crane having a vertical boom capable of being derricked and telescopically moved in multiple stages, and a swingable horizontal boom connected with a head of said vertical boom so that the horizontal boom can be telescopically moved in multiple stages and be derricked, wherein said horizontal boom can be pirouetted in a widthwise direction of said vertical boom from an operational position to a storage position parallel to a side of said vertical boom, wherein said horizontal boom can be locked to said vertical boom by a first locking apparatus when said horizontal boom is in said storage position, and wherein said horizontal boom can be locked to said vertical boom by a second locking apparatus when said horizontal boom is in said operational position, said method comprising the steps of:

operating said vertical boom to erect said vertical boom;

detecting when said vertical boom is erected at a predetermined derricking angle;

starting to unlock said first locking apparatus after said vertical boom has been detected to be erected at said predetermined derricking angle;

starting to pirouette said horizontal boom after the unlocking of said first locking apparatus is completed;

starting to lock said second locking apparatus after said horizontal boom has pirouetted a predetermined pirouetting angle;

starting to erect said horizontal boom after the locking of said second locking apparatus is completed; and then starting to telescopically move and derrick said horizontal boom.

17. A method in accordance with claim 16, wherein the step of starting to telescopically move and derrick said horizonal boom is started after said horizontal boom is erected such that said horizontal boom is parallel to the ground.

18. A method in accordance with claim 16, wherein the step of starting to unlock said first locking apparatus is started after said vertical boom has been detected to be erected at said predetermined derricking angle and said vertical boom has been telescopically extended.

19. A method for controlling an operation of a reach tower crane having a vertical boom capable of being derricked and telescopically moved in multiple stages, and a swingable horizontal boom connected with a head of said vertical boom so that the horizontal boom can be telescopically moved in multiple stages and be derricked, wherein said horizontal boom can be pirouetted in a widthwise direction of said vertical boom from an operational position to a storage position parallel to a side of said vertical boom, wherein said horizontal boom can be locked to said vertical boom by a first locking apparatus when said horizontal boom is in said storage position, and wherein said horizontal boom can be secured with respect to said vertical boom by a second locking apparatus when said horizontal boom is in said operational position, said method comprising the steps of:

retracting said horizontal boom to its shortest length;

positioning said vertical boom at a predetermined derricking angle;

starting to lower said horizontal boom after said horizontal boos has been retracted to its shortest length and said vertical boom has been positioned at said predetermined derricking angle;

starting to unlock said second locking apparatus after said horizontal boom has been lowered to a maximum angle of lowering;

starting to pirouette said horizontal boom after the unlocking of said second locking apparatus is completed;

starting to lock said first locking apparatus after said horizontal boom has pirouetted a predetermined pirouetting angle; and starting to lower said vertical boom after the locking by said first locking apparatus is completed.

20. A method in accordance with claim 19, further comprising retracting said vertical boom to its shortest length before said step of starting to lower said horizontal boom; and wherein said step of starting to lower said horizontal boom comprises starting to lower said horizontal boom after said vertical boom and said horizontal boom have been retracted to their shortest length and said vertical boom has been positioned at said predetermined derricking angle.

* * * * *

UNITED STATES PATENT AND TRADEMARK OFFICE

CERTIFICATE OF CORRECTION

PATENT NO. : 5,769,251

DATED : June 23, 1998

INVENTOR(S) : Minoru Wada, et al

It is certified that error appears in the above-identified patent and that said Letters Patent is hereby corrected as shown below:

In column 12, line 46, claim 1, delete "biting" and insert --being--.

In column 14, line 26, claim 5, delete "find" and insert --and--.

In column 15, line 23, claim 7, delete "notion" and insert --motion--.

In column 16, line 31, claim 9, delete "causes" and insert --cause--.

In column 16, line 35, claim 9, delete the comma after "verifying".

In column 17, line 54, claim 14, delete "valves" and insert --valve--.

In column 19, line 2, claim 19, delete "boos" and insert --boom--.

Signed and Sealed this

Thirtieth Day of March, 1999

*Attest:*

Q. TODD DICKINSON

*Attesting Officer*

*Acting Commissioner of Patents and Trademarks*